United States Patent [19]

Matsui et al.

[11] Patent Number: 4,880,176

[45] Date of Patent: Nov. 14, 1989

[54] YARN END FINDING DEVICE

[75] Inventors: Isamu Matsui, Kyoto; Hiroshi Uchida, Oumihachiman; Hirao Otojima, Shiga; Yoshihiro Kino, Nagaokakyo, all of Japan

[73] Assignee: Murata Kikai Kabushiki Kaisha, Kyoto, Japan

[21] Appl. No.: 66,419

[22] PCT Filed: Oct. 15, 1985

[86] PCT No.: PCT/JP85/00574

§ 371 Date: Jun. 5, 1987

§ 102(e) Date: Jun. 5, 1987

[87] PCT Pub. No.: WO87/02342

PCT Pub. Date: Apr. 23, 1987

[51] Int. Cl.[4] ..... B65H 54/22; B65H 67/08

[52] U.S. Cl. ..... 242/35.6 E; 242/18 R

[58] Field of Search ..... 242/35.6 E, 35.6 R, 242/35.5 R, 35.5 A, 18 R; 139/246, 247, 257

[56] References Cited

U.S. PATENT DOCUMENTS

| | | | |
|---|---|---|---|
| 3,108,618 | 10/1963 | Kondo et al. | 139/257 |
| 3,236,464 | 2/1966 | Wey | 242/35.6 E X |
| 3,279,712 | 10/1966 | Furst | 242/35.5 R |
| 3,295,775 | 1/1967 | Raasch et al. | 242/35.5 R |
| 3,381,908 | 5/1968 | Igushi et al. | 242/35.6 E X |
| 3,406,920 | 10/1968 | Kamp | 242/35.6 E |
| 3,897,022 | 7/1975 | Savio | 242/35.6 E |
| 3,941,323 | 3/1976 | D'Aqnolo et al. | 242/35.6 E X |
| 4,009,840 | 3/1977 | Muller | 242/35.6 E |
| 4,606,509 | 8/1986 | Hiroaki | 242/35.6 R |
| 4,616,789 | 10/1986 | Matsui et al. | 242/35.5 R |

*Primary Examiner*—Stanley N. Gilreath

*Attorney, Agent, or Firm*—Spensley Horn Jubas & Lubitz

[57] ABSTRACT

A yarn end finding device for releasing a bunch winding wound around an end of a spinning bobbin to find a yarn end and supplying the yarn-end found spinning bobbin to an automatic winder, the yarn end finding device comprising rotary rollers 15 and 16 adapted to press against a take-up tube 11 at a bunch winding position of the spinning bobbin, the rotary rollers having rotary axes C1 and C2 inclined in a direction different from an axis C3 of the take-up tube 11.

23 Claims, 5 Drawing Sheets

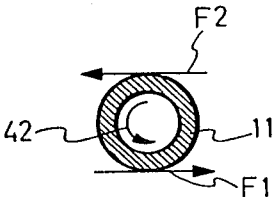
FIG. 7
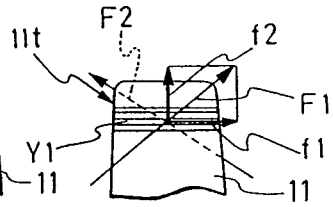
FIG. 6-A
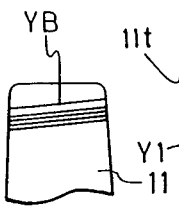
FIG. 6-B
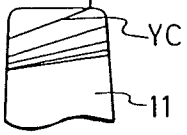
FIG. 6-C
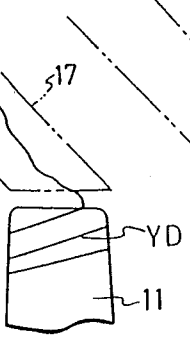
FIG. 6-D
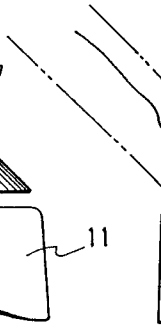
FIG. 6-E
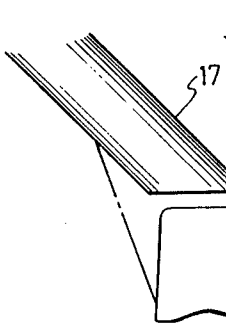

YARN END FINDING DEVICE

BACKGROUND OF THE INVENTION

1. Field of the Invention

The present invention relates to a yarn end finding device for releasing a bunch winding wound around an end of a spinning bobbin to find a yarn end.

2. Description of the Related Art

To one end of a spinning bobbin around which yarn is wound by a spinning machine, particularly a ring spinning machine is applied a bunch winding around which a plurality of yarn ends are wound to prevent the yarn being transported from being released. In supplying such a spinning bobbin to an automatic winder in the rewinding step, the bobbin is supplied in the state wherein said bunch winding is released.

For this reason, various yarn end finding devices have been proposed. For example, a yarn end is released by a suction air while injecting compressed air toward the end of the bobbin in a direction of releasing the yarn. Alternatively, a bunch winding is gripped by an opening and closing gripper in the form of scissors and moved relatively in an axial direction of a bobbin to forcibly remove the bunch winding in a pull-out fashion rather than releasing.

According to the devices as described above, where air is used, in a bobbin to which a yarn end is clung, yarn end finding error sometimes occurs. Also in the forcibly pull-out type, in the firmly wound bunch winding, there involves drawbacks in that a releasing error occurs, and the surface of the take-up tube is scratched.

SUMMARY OF THE INVENTION

The present invention overcomes the above-described drawbacks and provides a positive yarn end finding device.

According to an embodiment of the present invention, a peripheral surface of a roller which rotates around one axis is pressed against the bunch winding position of a spinning bobbin, and a rotary axis of the roller is inclined in a direction different from the direction of inclination of the axis of a take-up tube.

The peripheral surface of the roller, which rotates around the axis in a direction of rotation which is different from the direction of rotation of the take-up tube, is pressed against the bunch winding position to provide a force for gradually displacing a yarn layer of the bunch winding wound around the take-up tube toward the axis of the take-up tube, thus easily releasing even the firmly wound bunch winding.

BRIEF DESCRIPTION OF THE DRAWINGS

FIG. 6-A is a front view showing the relationship between a turning force of a roller and a bobbin rotation according to an embodiment of the present invention;

FIG. 6-B is a front view showing the initial state wherein a wound yarn is unwound according to an embodiment of the present invention;

FIG. 6-C is a front view which illustrates the state a wound yarn is further unwound according to an embodiment of the present invention;

FIG. 6-D is a front view showing the state wherein the unwound yarn is attracted by an attracting pipe according to an embodiment of the present invention;

FIG. 6-E is a front view showing the state wherein a bunch winding is completely released according to an embodiment of the present invention; and FIG. 7 is a plan view of FIG. 6-A.

DESCRIPTION OF THE PREFERRED EMBODIMENTS

The embodiments of the present invention will be described hereinafter with reference to the drawings.

Figure 1:
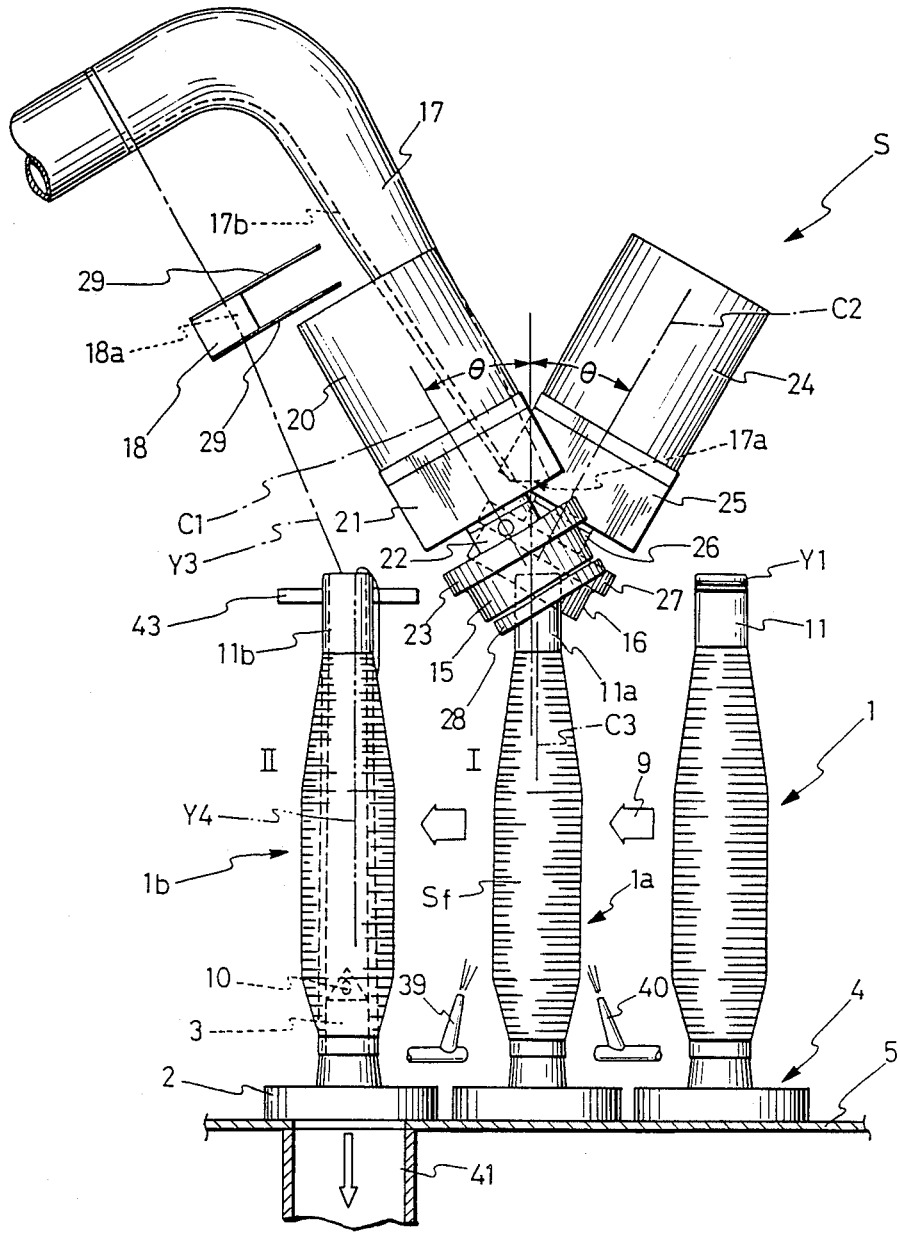
FIG. 1 is a front view showing an apparatus according to an embodiment of the present invention.
Figure 4:
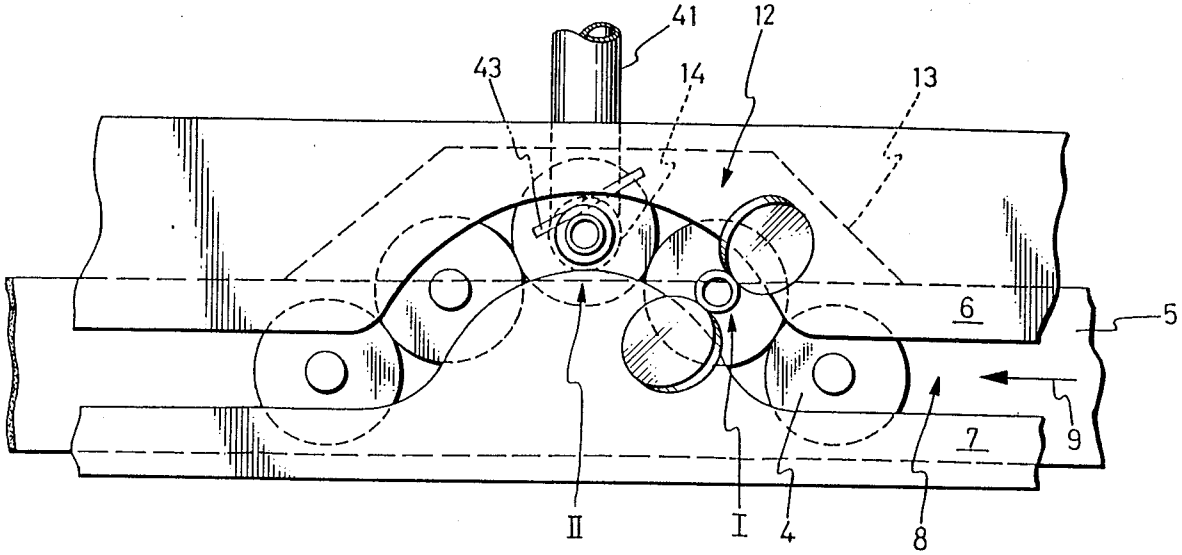
FIG. 4 is a plan view showing a bobbin transporting passage according to an embodiment of the present invention.

In FIGS. 1 and 4, a spinning bobbin 1 in the state being inserted and stood on a tray 4 formed from a peg 3 projected on a disc-like base plate 2 is transported in a direction as indicated by arrow 9 along a passage 8 formed by guide plates 6 and 7 on a conveyor 5. The bobbin tray 4 has an internal space a lower surface of which is open and is formed at a forward end of the peg 3 with an air passage hole 10, so that a yarn end finding portion is transported, in the state being suspended from the upper and within a take-up tube or a bobbin, to a winder. The tray passage 8 is formed into a passage curved in a yarn end finding processing station 12 as shown in FIG. 4, and a bottom guide plate 13 is fixed on the same plane as that of the conveyor 5. In position I, the bunch winding is released, and in position II, the released yarn end is cut into a given length and attracted into the take-up tube. Therefore, a hole 14 for passage of an attracted air is formed in a guide plate 13 directly below the tray in position II.

A yarn end finding device S will be described with reference to FIGS. 1 to 3. That is, the yarn end finding device S is composed of rotary rollers 15 and 16 arranged on opposite sides of a bobbin 1*a* in the bunch winding releasing position, an attraction pipe 17 for attracting the released yarn end, a cutter 18 for cutting the attracted yarn end into a given length, etc. One rotary roller 15 is secured to a rotary shaft 22 through a motor 20 secured to a bracket 19 and a reduction gear 21. The roller 15 is formed with a large diameter flange 23, and a small diameter portion 15 is coated with a member having a great coefficient of friction such as rubber. The flange portion 23 is provided to stop upward movement of the take-up tube at a fixed position when the roller 15 is inclined to press against a take-up tube 11*a*.

The other roller 16 is also secured to a rotary shaft 26 through a motor 24 secured to a bracket and a reduction gear 25, and the roller 16 is formed with a flange portion 27.

Axes C1 and C2 of the rotary shafts 22 and 26 of the rotary rollers 15 and 16 respectively are inclined at an angle $\theta$ with respect to an axis C3 of the bobbin 1 and are arranged so that they may be urged from both sides of the take-up tube 11*a*. Furthermore, as shown in FIGS. 1 and 3, a line L1 connecting between rotational centers of the rotary rollers 15 and 16 is arranged to be slightly deviated through $\alpha$, and a locating member 28 for locating the upper end of the take-up tube 11*a* is mounted on a bracket of one rotary roller 15 by means of a mounting member not shown. In the case of the illustrated embodiment, the locating member 28 comprises a rotary disc, and the take-up tube 11*a* is supported and positioned at three points, the first and second rotary rollers 15, 16 and the disc 28 so that even when the take-up tube is rotated, the yarn end releasing may be carried out smoothly without deflection of the forward end thereof. It is noted that the disc 28 may be replaced by other non-rotary abutment member which is brought into abutment with a part of the take-up tube.

A suction pipe 17 is provided above the bobbin 1*a* at the yarn end finding position so that an open end 17*a* of the suction pipe 17 is positioned adjacent the bobbin 1*a*, as shown in FIGS. 6C–E. The suction pipe 17 is formed with a slit 17*b* for guiding the yarn end to a position of a cutter 18 over a suitable length from the open end 17*a*. In addition, the yarn cutter 18 and a guide plate 29 are arranged through a bracket 30 in the yarn running area, on which the yarn travels, along the slit 17*b* of the suction pipe 17. The cutter 18 may be of one internally provided with a sensor for detecting presence or absence of a yarn and a cutter having a movable blade actuated according to a yarn-presence signal of said sensor, or one in which sensor and cutter are separated, which can be suitably selected. Alternatively, when the sensor within the cutter 18 detects the absence of yarn, thereby sensing that the yarn end finding device has missed finding the yarn end on the bobbin, the bobbin is determined to be a yarn end finding miss bobbin and is discharged from a normal transporting passage. That is, a movable gate actuated according to the yarn-absence signal of the sensor is provided at the inlet side of a branch passage branched from the transporting passage so that bobbins are portioned out into a yarn end finding success bobbin and a yarn end finding miss bobbin, which have passed through the yarn end finding device, by the opening and closing of the movable gate and are moved to the normal transporting passage and the branch passage, respectively.

Figure 2:
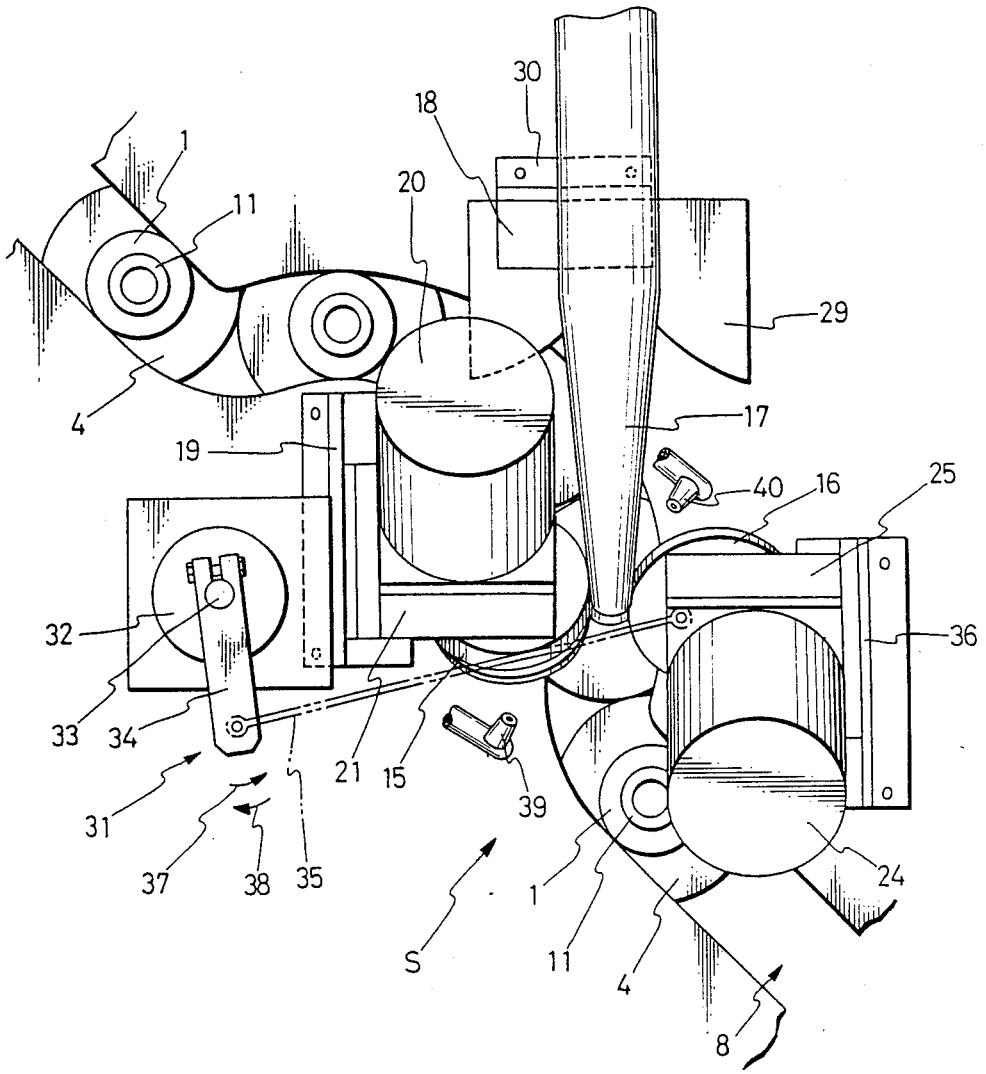
FIG. 2 is a plan view of the apparatus shown in FIG. 1.
Figure 3:
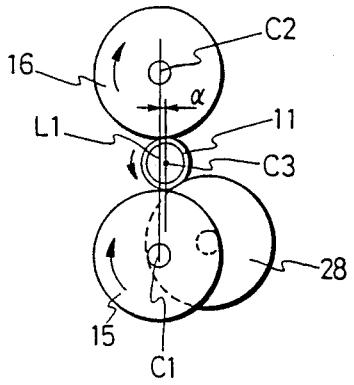
FIG. 3 is an explanatory plan view showing the relationship between a rotating axis of a rotary roller and an axis of a bobbin according to an embodiment of the present invention.

Furthermore, in FIG. 2, there is provided a roller engaging and disengaging device 31 for bringing the take-up tube into engagement with or disengagement from the respective rotary rollers 15 and 16. That is, a rotary solenoid 32 is secured to a bracket 19 on which one roller 15 driving motor 20 is mounted, and a connecting bar 35 is connected between a pivotal lever 34 secured to an output shaft 33 of the rotary solenoid 32 and the other roller 16 driving motor 24 so that the rotary rollers 15 and 16 may be moved close to and away therefrom by utilization of flexture of the brackets 19 and 36 in a lateral direction. It is to be noted of course that the brackets carrying thereon the rotary rollers 15 and 16 may be supported pivotably within the horizontal plane to thereby engage and disengage the rollers 15 and 16. In the case of the FIG. 2 embodiment, when the pivotal lever 34 is moved through a fixed angle in a direction as indicated at arrow 37, the brackets 19 and 36 are flexed in the direction in which the rollers are moved away from each other, whilst when moved in a direction as indicated at arrow 38, the brackets 19 and 36 are flexed in a direction in which the rollers 15 and 16 are moved close to each other.

In FIGS. 1 and 2, compressed air injection nozzles 39 and 40 provided on both sides below the bobbin make it possible to effect yarn end finding having no top bunch and with a yarn end attached to a yarn layer surface Sf of the spinning bobbin 1*a*. The nozzles 39 and 40 are arranged so that they are inclined toward the surface of the yarn end and air may be injected in a direction of releasing the yarn end.

Next, the yarn end finding of the yarn end finding device as described above will be explained.

In FIGS. 1 and 4, the spinning bobbin 1 having a top bunch Y1 in the state being inserted and stood on the bobbin tray 4 is transported on the conveyor 5 in a direction as indicated at arrow 9, and the bobbin 1 reaches the bunch winding releasing position I, the bobbin stops. Subsequently, the rollers 15 and 16 is pressed against the take-up tube 11*a* by the activation of the rotatary solenoid 32 shown in FIG. 2. At that time, the rotary rollers 15 and 16 are already in rotation by the drive of the motors 20 and 24, and also the suctioning of the suction pipe 17 and the air injection from the nozzles 39 and 40 are being carried out. When the peripheral surfaces of the inclined rotary rollers 15 and 16 are pressed against the bunch winding position of the take-up tube, the take-up tube is rotated in a direction in which the yarn end is released by the component of the turning force of the rollers 15 and 16, the force exerts on the yarn of the bunch winding to raise the latter axially upwardly of the take-up tube, and the take-up tube 11*a* has a tapered surface to be narrowed toward the upper forward end, and therefore the yarn of the bunch winding is easily released and disengaged upwardly from the take-up tube 11*a*, whereby the yarn is suctioned or attracted by the suction pipe 17.

Figure 5:
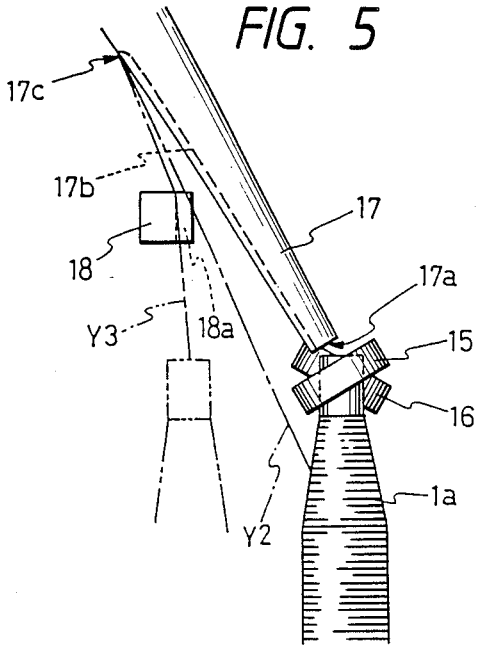
FIG. 5 is a schematic view showing a yarn running area of a released yarn end according to an embodiment of the present invention.

The released and suctioned yarn end moves along the slit 11*b* of the suction pipe 17, and guided toward the cutter device 18 while being guided by the guide plate 29 of FIGS. 1 and 2. At that time, as shown in FIG. 5, the yarn Y2 positioned between the slit end 17*c* of the suction pipe 17 and the bobbin 1*a* is not yet arrived at a predetermined position of the cutter 18, and when the bobbin 1*a* arrives at the yarn end suction position II of FIGS. 1 and 5, the yarn Y3 moves into the groove 18*a* of the cutter device to insure the presence of the yarn by the sensor encased within the cutter, whereby the cutter is actuated to cut the yarn at the cutter position. The cut end of the yarn on the side of the suction pipe 17 of the cut yarn is suctioned into the suction pipe 17 for removal. On the other hand, the yarn end on the bobbin 1*b* is suctioned into the take-up tube from the upper end of the take-up pipe 11*b* by the inject effect resulting from the suction air of the suction pipe 41 below the tray 4 in FIG. 1, and the yarn end of a fixed length assumes a state hung down into the take-up pipe as shown by the dash-dotted contour lines Y4 to terminate the yarn end finding operation.

The top bunch releasing operation will be described in detail with reference to FIGS. 6-A through 6-E. That is, since the rotary roller with the axis inclined is pressed against the bunch winding position, the component f1 of the turning forces F1 and F2 of the roller takes the form of a force for rotating the bobbin in a direction as indicated at arrow 42, that is, in a direction in which the yarn is released, whereas the component f2 in the axial direction of the bobbin takes the form of a force for displacing the bunch winding yarn Y1 upwardly along the surface of the take-up tube 11, whereby as shown in FIGS. 6-B and 6-C, the yarn moves upward while being unwound, and the yarn end YC disengaged from the take-up tube 11 is taken into the suction pipe 17. The unwound yarn YD is released and suctioned by the interaction of the suction force of the suction pipe 17 and the action of the rotary rollers to completely release the bunch winding as shown in FIGS. 6-D and 6-E. It is noted actually that other than the release of the bunch winding as shown in the schematic views of FIGS. 6-A to 6-E, when the bunch winding yarn Y1 is wholly displaced upwardly of the take-up tube 11, it is sometimes in a manner of being removed from a ring by the provision of the tapered surface 11*t* of the take-up tube 11.

In the case of a bobbin not formed with a top bunch but a yarn end attached to the surface of the yarn layer Sf of FIG. 1, the attached yarn layer is blown upwardly by the injection nozzles 39 and 40, and the yarn layer is directedly suctioned by the suction pipe 17.

It is noted that the guide member 43 at the yarn end suction position shown in FIGS. 1 and 4 is provided for the contact thereof with the upper end of the take-up tube 11 of the bobbin to prevent deflection of the upper end of the bobbin, i.e., for locating of a bobbin when the cut yarn end is suctioned, and for locating of a yarn positioned between the cutter 18 and the bobbin 1*b*, so that the cut yarn end may be positively taken into the take-up tube 11*c*. The guide member 43 is formed from a plate or a wire.

INDUSTRIAL APPLICABILITY

In supplying a spinning bobbin to an automatic winder in the rewinding step, a bunch winding wound about the spinning bobbin may be released by the yarn end finding device according to the present invention to thereby positively release the bunch winding without damaging the surface of the take-up tube. Moreover, since the releasing of the bunch winding according to an embodiment of the present invention may be carried out while carrying the spinning bobbin on the transporting medium such as a tray, the operation is quickly accomplished and in addition the entire system may be advantageously automated.

What is claimed is:

1. A yarn end finding device, operable with a drive device, for releasing a bunch winding wound about the axis of a spinning bobbin at a bunch winding position of the take up tube of said spinning bobbin, said yarn end finding device comprising:

a plurality of rotatable rollers operable to abut the bunch winding position, at least one of said rotatable rollers being rotatably drivable about an axis of rotation by the drive device;

wherein said axis of rotation of at least one of said rotatable rollers is angled with respect to the axis and the directions perpendicular to the axis of the spinning bobbin.

2. The device according to claim 1, wherein said rotatable rollers are arranged with the geometric line connecting the centers of rotation of said rollers being intersected by said bunch winding position of said take-up tube.

3. The device according to claim 2, further comprising:

a movement means for moving said rollers toward and away from each other to thereby urge said rollers against said take-up tube and move said rollers away from said take-up tube, respectively.

4. The device according to claim 2, wherein said rollers are provided with flanges, and wherein the outer peripheral surfaces of said rollers are provided with a friction material.

5. The device according to claim 2, further comprising:

a locating means operable for contacting and locating an end of said take-up tube;

wherein said geometric line connecting the centers of rotation of said rollers is adjacent and spaced from said axis of said take-up tube.

6. The device according to claim 5, wherein said locating means comprises a rotary disc.

7. The device according to any of claims 1, 2, 3, 4, 5, or 6, further comprising:

a suction pipe for taking in a released yarn end; and a cutter for cutting the suctioned yarn end into a fixed length.

8. A yarn end finding device, operable with a drive device, for releasing a bunch winding of yarn wound about the axis of a spinning bobbin, said yarn end finding device comprising:

a first roller rotatably drivable about a first axis of rotation by the drive device, said first roller having an outer peripheral surface operable for abutting the yarn wound about the axis of the spinning bobbin;

a second roller rotatable about a second axis of rotation, said second roller having an outer peripheral surface operable for abutting the yarn wound about the axis of the spinning bobbin;

wherein said first axis of rotation is provided at an angle with respect to the direction of the axis and the directions perpendicular to the axis of said spinning bobbin.

9. A yarn end finding device as claimed in claim 8, wherein said second axis of rotation is provided at an angle with respect to said axis of said spinning bobbin.

10. A yarn end finding device as claimed in claim 8, wherein said second axis of rotation is provided at an angle with respect to said first axis of rotation.

11. A yarn end releasing device, operable with a drive device, for releasing a yarn end from a layer of yarn wound about the axis of a spinning bobbin, said yarn end releasing device comprising:

at least one rotatable roller rotatable roller rotatably drivable about a roller axis by the drive device, said at least one rotatable roller having an outer peripheral surface abutting said layer of yarn;

wherein said roller axis is provided at an angle with respect to the axis of the spinning bobbin and also with respect to the directions perpendicular to the axis of the spinning bobbin.

12. A method for releasing a yarn end from a yarn wound about an axis of a spinning bobbin, said method comprising the steps of:

pressing a first rotatable roller against said yarn wound about said spinning bobbin; and rotating said first rotatable roller about a first axis which is angled with respect to said axis of said spinning bobbin and with respect to the directions perpendicular to said axis of said spinning bobbin.

13. A method as claimed in claim 12, further comprising the steps of:

pressing a second rotatable roller against said yarn wound about said spinning bobbin; and rotating said second rotatable roller about a second axis.

14. A method as claimed in claim 13, wherein said second axis is angled with respect to said axis of said spinning bobbin.

15. A method as claimed in claim 13, wherein said second axis is angled with respect to said first axis.

16. A method as claimed in claim 12, wherein said spinning bobbin has a bunch winding position and said first rotatable roller has a peripheral surface which is operable to abut said bunch winding position.

17. A yarn end finding device as claimed in claim 1, wherein said plurality of rotatable rollers are operable to impart a force on the bunch winding position, said force having a first component in the unwinding direction of the yarn wound about the spinning bobbin, said force having a second component in the direction substantially parallel with the axis of the spinning bobbin.

18. A yarn end finding device as claimed in claim 8, wherein said first and second rollers are operable to impart a force on the yarn, said force having a first force component in the unwinding direction of the yarn wound about the spinning bobbin, said force having a second force component in the direction substantially parallel with the axis of the spinning bobbin.

19. A yarn end releasing device as claimed in claim 11 wherein said at least one rotatable roller is operable to impart a force on the layer of yarn, said force having a first force component in the unwinding direction of the yarn wound about the spinning bobbin, said force having a second force component in the direction substantially parallel with the axis of the spinning bobbin.

20. A method as claimed in claim 12 wherein said steps of pressing and rotating impart a force on the yarn wound about the spinning bobbin, said force having a first force component in the unwinding direction of the yarn wound about the spinning bobbin, said force having a second force component in the direction substantially parallel with the axis of the spinning bobbin.

21. A yarn end finding device for releasing a bunch winding of yarn wound about the axis of a spinning bobbin, said yarn end finding device comprising:

at least one abutting member having a surface for abutting the bunch winding; and moving means, operatively connected with said at least one abutting member, for moving said surface in a first direction, said first direction having a linear direction component which is angled with respect to the axis of the spinning bobbin and with respect to the perpendicular of the spinning bobbin axis;

wherein said at least one abutting member is operable for imparting a first force component and a second force component on the bunch winding, said first force component being directed substantially in the unwinding direction of the bunch winding and said second force component being in the direction substantially parallel with the axis of the spinning bobbin.

22. A yarn end finding device as claimed in claim 21, wherein said at least one abutting member comprises at least one rotatable roller rotatable about an axis of rotation, said axis of rotation being angled with respect to the axis of the spinning bobbin.

23. A yarn end finding device as claimed in claim 22 wherein said moving means comprises drive means for rotatably driving said at least one rotatable roller.

* * * * *